US008777215B2

(12) United States Patent
Ohkura

(10) Patent No.: US 8,777,215 B2
(45) Date of Patent: Jul. 15, 2014

(54) SHEET FEEDING DEVICE, IMAGE FORMING APPARATUS INCLUDING THE SAME, AND METHOD OF CONTROLLING THE SHEET FEEDING DEVICE

(75) Inventor: Yoshimasa Ohkura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 13/429,534

(22) Filed: Mar. 26, 2012

(65) Prior Publication Data

US 2013/0069301 A1 Mar. 21, 2013

(30) Foreign Application Priority Data

Mar. 30, 2011 (JP) ..... 2011-073898

(51) Int. Cl.

| | |
|---|---|
| ***B65H 1/26*** | (2006.01) |
| ***B65H 1/08*** | (2006.01) |
| ***B65H 3/34*** | (2006.01) |
| ***B65H 3/66*** | (2006.01) |
| ***B65H 3/52*** | (2006.01) |

(52) U.S. Cl.

CPC ..... *B65H 3/66* (2013.01); *B65H 3/5223* (2013.01); *B65H 2301/531* (2013.01); *B65H 2301/533* (2013.01)

USPC ..... 271/167; 271/160; 271/157

(58) Field of Classification Search

CPC ..... B65H 2301/531; B65H 2301/533; B65H 3/5223; B65H 3/66

USPC ..... 271/157, 160, 167, 109

See application file for complete search history.

(56) References Cited

U.S. PATENT DOCUMENTS

| | | | | |
|---|---|---|---|---|
| 4,843,436 | A * | 6/1989 | Evangelista et al. | 355/133 |
| 5,564,970 | A * | 10/1996 | Olson et al. | 451/428 |
| 7,913,997 | B2 * | 3/2011 | Watanabe | 271/167 |
| 8,360,415 | B1 * | 1/2013 | Herrmann et al. | 271/109 |
| 8,439,354 | B1 * | 5/2013 | Park et al. | 271/121 |
| 2005/0001371 | A1 * | 1/2005 | Otsuki | 271/113 |
| 2007/0210507 | A1 * | 9/2007 | Izuchi | 271/121 |
| 2008/0150220 | A1 * | 6/2008 | Eltzroth et al. | 271/167 |
| 2009/0140489 | A1 * | 6/2009 | Takeuchi et al. | 271/109 |
| 2011/0097130 | A1 * | 4/2011 | Hashimoto | 400/583 |

FOREIGN PATENT DOCUMENTS

| | | | | |
|---|---|---|---|---|
| JP | 03128832 | A * | 5/1991 | B65H 3/46 |
| JP | 8-328323 | A | 12/1996 | |
| JP | H11-314781 | A | 11/1999 | |
| JP | 2001-63185 | A | 3/2001 | |
| JP | 2002-193466 | A | 7/2002 | |
| JP | 2008-143647 | | 6/2008 | |

* cited by examiner

*Primary Examiner* — Patrick Cicchino

(74) *Attorney, Agent, or Firm* — Morgan, Lewis & Bockius LLP

(57) ABSTRACT

Provided is a sheet feeding device capable of cleaning a pickup roller satisfactorily, which is downsized and reduced in the number of components. The sheet feeding device rotates the pickup roller under a state in which the pickup roller abuts against a friction body, to thereby clean the pickup roller.

7 Claims, 8 Drawing Sheets

SHEET FEEDING DEVICE, IMAGE FORMING APPARATUS INCLUDING THE SAME, AND METHOD OF CONTROLLING THE SHEET FEEDING DEVICE

This application is based upon and claims the benefit of priority from the corresponding Japanese Patent Application No. 2011-073898 filed on Mar. 30, 2011, the entire contents of which are incorporated herein by reference.

BACKGROUND OF THE DISCLOSURE

1. Field of the Disclosure

The present disclosure relates to a sheet feeding device, an image forming apparatus including the sheet feeding device, and a method of controlling the sheet feeding device.

2. Description of Related Art

A conventional image forming apparatus includes at least a placement member on which a sheet is to be placed, and a sheet feeding device including a pickup roller for pulling out the sheet from the placement member. The sheet feeding device performs a sheet-feed operation as follows. The sheet feeding device brings the sheet placed on the placement member into abutment against an outer circumferential surface of the pickup roller, and, in that state, rotates the pickup roller to pull out the sheet from the placement member. Then, the sheet pulled out from the placement member is fed to a sheet conveying path provided inside the image forming apparatus.

In the conventional configuration, when sheet powder flown from the sheet adheres to the outer circumferential surface of the pickup roller, the pickup roller idly rotates in spite of the fact that the pickup roller and the sheet abut against each other, which causes a trouble that the sheet is not pulled out from the placement member satisfactorily.

In this context, in the related art, a sheet feeding device has been proposed in which a cleaning member such as a cleaning belt is provided separately and is allowed to circulate while abutting against the outer circumferential surface of the pickup roller, and thus, paper powder adhering to the outer circumferential surface of the pickup roller is removed.

In the proposed conventional configuration, the cleaning member for cleaning the pickup roller is provided separately, and hence, the pickup roller can be cleaned reliably. However, when the cleaning member is provided separately, there is a new problem in that the number of components increases to raise cost. Further, it is necessary to secure a space for disposing the cleaning member, which hinders downsizing of the sheet feeding device, and thus it becomes difficult to install the sheet feeding device in a small image forming apparatus.

SUMMARY OF THE DISCLOSURE

The present disclosure has been made to solve the above-mentioned problems, and therefore has an object to provide a sheet feeding device capable of cleaning a pickup roller satisfactorily, which is downsized and prevented from an increase in number of components, and to provide an image forming apparatus including the sheet feeding device, and a method of controlling the sheet feeding device.

In order to achieve the above-mentioned object, according to an exemplary embodiment of the present disclosure, a sheet feeding device includes a placement member having a placement surface on which a recording medium is placed, a friction body mounted to a part of the placement surface of the placement member, a pickup roller disposed so as to be opposed to the friction body on a side of the placement surface of the placement member, for pulling out the recording medium from the placement member by rotating in abutment against the recording medium, a drive mechanism for rotationally driving the pickup roller, and a lifting member for lifting up the placement member so as to bring the recording medium into abutment against the pickup roller when the recording medium is placed on the placement member and bring the friction body into abutment against the pickup roller when the recording medium is not placed on the placement member. Further, the drive mechanism rotates the pickup roller under a state in which the pickup roller abuts against the friction body, to thereby clean the pickup roller.

According to the present disclosure, it is possible to clean the pickup roller satisfactorily, while downsizing the sheet feeding device and reducing the number of components of the sheet feeding device.

Further features and advantages of the present disclosure will become apparent from the description of embodiments given below.

DETAILED DESCRIPTION OF PREFERRED EMBODIMENT

Figure 1:
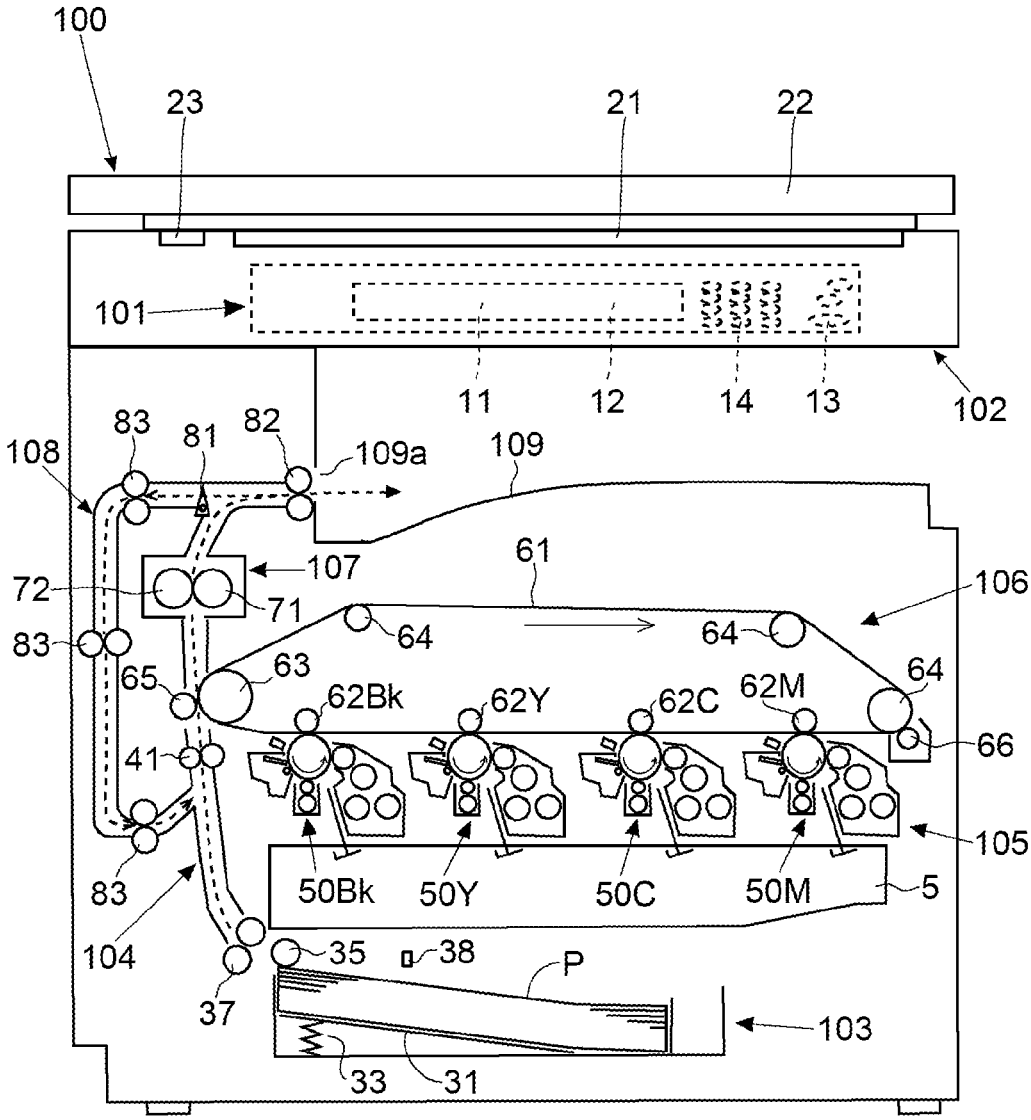
FIG. 1 is a view of an overall structure of an image forming apparatus including a sheet feeding device according to an embodiment of the present disclosure.

First, an overall configuration of a multifunction peripheral 100 (corresponding to an image forming apparatus) according to an embodiment of the present disclosure is described with reference to FIG. 1. The multifunction peripheral 100 of this embodiment is a tandem-type color copier.

The multifunction peripheral 100 of this embodiment includes at least an operation panel 101, an image reading unit 102, a sheet-feed unit 103 (corresponding to a sheet feeding device), a conveying path 104, an image forming unit 105, an intermediate transfer unit 106, a fixing unit 107, and a duplex conveying path 108.

The operation panel 101 is indicated by a broken line of FIG. 1 and has a liquid crystal display unit 11 (corresponding to a display unit) for displaying an apparatus state, various messages, etc.

The liquid crystal display unit 11 displays at least one key for selecting and setting a function. The liquid crystal display unit 11 is covered with a transparent touch panel unit 12 (corresponding to an operation unit). Further, the operation panel 101 is provided with hard keys such as a start key 13 for instructing the start of execution of various functions and a numerical pad 14.

The image reading unit 102 reads a document and forms image data on the document. The image reading unit 102 is provided with optical members (not shown) such as an exposure lamp, a mirror, a lens, and an image sensor. The image reading unit 102 irradiates a document placed on a contact glass 21 for reading in placement with a beam, and performs A/D conversion of an output value of each pixel of the image sensor having received the beam reflected from the document to generate image data.

When the image reading unit 102 reads a document, the document placed on the contact glass 21 for reading in placement is pressed by a document cover 22. The document cover 22 has a document conveying function of conveying documents one by one to a contact glass 23 for reading in conveyance.

The sheet-feed unit 103 contains a sheet P as a recording medium and feeds the sheet P to the conveying path 104. The configuration of the sheet-feed unit 103 is described later in detail.

The conveying path 104 conveys the sheet P inside the multifunction peripheral 100. Specifically, the sheet P fed from the sheet-feed unit 103 is guided by the conveying path 104 to a delivery tray 109, passing through the intermediate transfer unit 106 and the fixing unit 107 in this order. The conveying path 104 is provided with registration rollers 41 for causing the sheet P to wait before the intermediate transfer unit 106 and sending the sheet P to the intermediate transfer unit 106 at an appropriate timing.

The image forming unit 105 forms a toner image based on the image data, and includes image forming sections 50 of four colors (image forming section 50Bk for forming a black toner image, an image forming section 50Y for forming a yellow toner image, an image forming section 50C for forming a cyan toner image, and an image forming section 50M for forming a magenta toner image), and an exposure device 5. Although forming toner images of different colors, the image forming sections 50Bk, 50Y, 50C, and 50M have basically the same configuration. Thus, in the following description, reference symbols (Bk, Y, C, and M) representing the respective colors are omitted.

Figure 2:
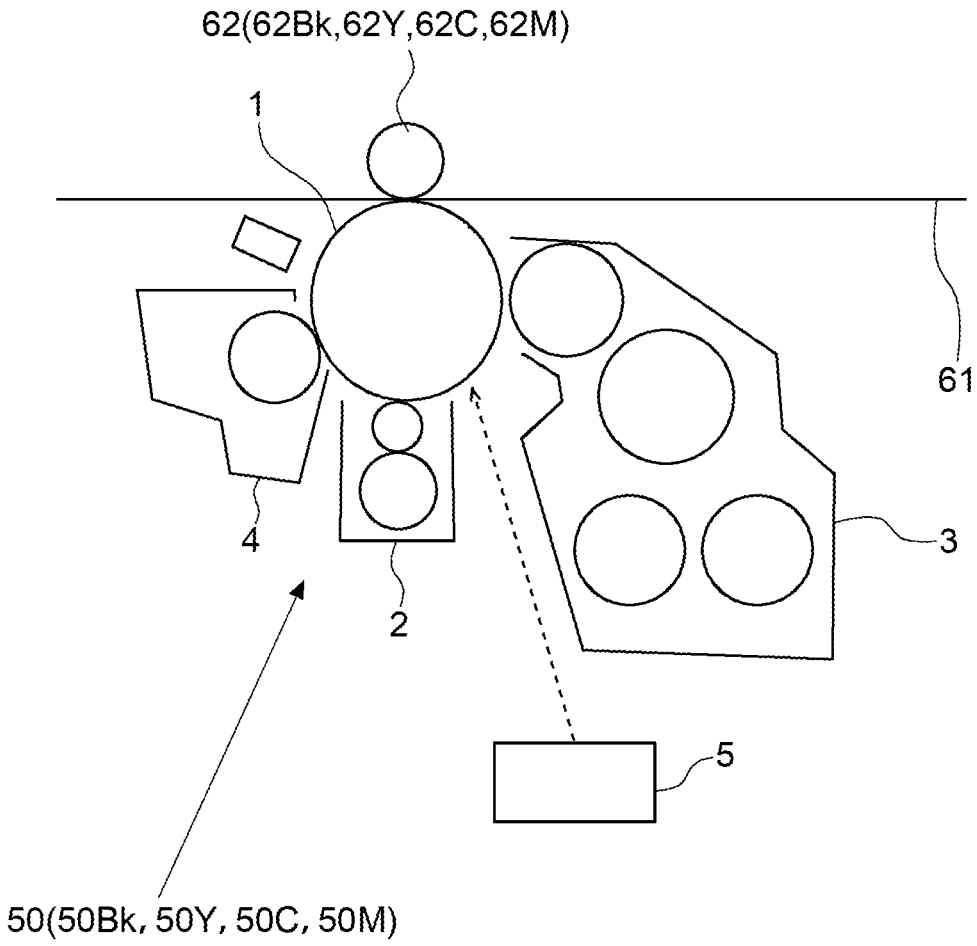
FIG. 2 is a schematic view of an image forming unit of the image forming apparatus illustrated in FIG. 1.

As illustrated in FIG. 2, each image forming section 50 includes a photosensitive drum 1, a charging device 2, a developing device 3, and a cleaning device 4. Each image forming section 50 shares the exposure device 5.

Each photosensitive drum 1 bears a toner image on an outer circumferential surface thereof, and has a photosensitive layer on the outer circumferential surface thereof. Each charging device 2 charges a corresponding photosensitive drum 1 at a predetermined potential. Each developing device 3 contains a developer of the corresponding color and supplies toner to the corresponding photosensitive drum 1. Each cleaning device 4 cleans the corresponding photosensitive drum 1. The exposure device 5 scans and exposes each photosensitive member 1 to form an electrostatic latent image.

Referring back to FIG. 1, the intermediate transfer unit 106 performs secondary transfer with respect to the sheet P after undergoing primary transfer of the toner image from the image forming unit 105. The intermediate transfer unit 106 includes at least an intermediate transfer belt 61 and primary transfer rollers 62Bk, 62Y, 62C, and 62M allocated respectively to the image forming sections 50. The primary transfer rollers 62Bk, 62Y, 62C, and 62M sandwich the intermediate transfer belt 61 together with the corresponding image forming sections 50 (specifically, the photosensitive drums 1), and a transfer voltage (transfer bias) is applied thereto.

Further, the intermediate transfer unit 106 also includes a drive roller 63 and driven rollers 64. The drive roller 63 and the driven rollers 64 are looped around by the intermediate transfer belt 61 together with the primary transfer rollers 62Bk, 62Y, 62C, and 62M.

Further, the intermediate transfer unit 106 also includes a secondary transfer roller 65. The secondary transfer roller 65 sandwiches the intermediate transfer belt 61 together with the drive roller 63, and a transfer voltage (transfer bias) is applied thereto.

The toner images formed by the respective image forming sections 50 are superimposed one on top of another successively without any shift by the primary transfer rollers 62Bk, 62Y, 62C, and 62M to which the transfer voltage is applied, and transferred primarily to the intermediate transfer belt 61. After that, the toner images transferred primarily to the intermediate transfer belt 61 are transferred secondarily to the sheet P by the secondary transfer roller 65 to which the transfer voltage is applied.

Further, the intermediate transfer unit 106 also includes a belt cleaning device 66. The belt cleaning device 66 cleans the intermediate transfer belt 61 after the toner images are transferred secondarily from the intermediate transfer belt 61 to the sheet P.

The fixing unit 107 heats and pressurizes the toner images transferred secondarily to the sheet P, to thereby fix the toner images. The fixing unit 107 includes a fixing roller 71 containing a heat generation source and a pressure roller 72 to be brought into press contact with the fixing roller 71. Then, the sheet P to which the toner images are transferred secondarily passes through a region between the fixing roller 71 and the pressure roller 72 to be heated and pressurized. Thus, the toner images are fixed to the sheet P.

Then, the sheet P passes through the fixing unit 107 and is then delivered to the delivery tray 109. Accordingly, an image forming process is completed.

Further, the duplex conveying path 108 enables duplex printing. The duplex conveying path 108 is branched from the conveying path 104 on a downstream side of the fixing unit 107 and joins the conveying path 104 on an upstream side of the registration rollers 41. The duplex conveying path 108 includes a switch tab 81 disposed at a branch point between the duplex conveying path 108 and the conveying path 104, delivery rollers 82 which are capable of switching between forward and backward rotations and are disposed at a delivery port 109*a* leading to the delivery tray 109, and conveying rollers 83 for conveying the sheet P.

When duplex printing is performed, the switch tab 81 is situated at a position for closing the duplex conveying path 108 and guides the sheet P sent from the fixing unit 107 to the delivery tray 109. Further, the delivery rollers 82 rotate forward temporarily, and deliver the sheet P to the delivery tray 109. After that, the delivery rollers 82 rotate backward before the sheet P completely passes through the delivery rollers 82. At this time, the switch tab 81 pivots in a direction of opening the duplex conveying path 108. Thus, the sheet P printed on one side is guided to the duplex conveying path 108.

The sheet P guided to the duplex conveying path 108 is conveyed by the conveying rollers 83 to reach the upstream side of the registration rollers 41. Then, the sheet P is sent from the intermediate transfer unit 106 to the fixing unit 107 again. At this time, the surfaces of the sheet P are reversed, and hence, a reverse surface (unprinted surface) of the sheet P is subjected to secondary transfer and fixing processes. Then, the sheet P subjected to duplex printing is delivered to the delivery tray 109.

Figure 3:
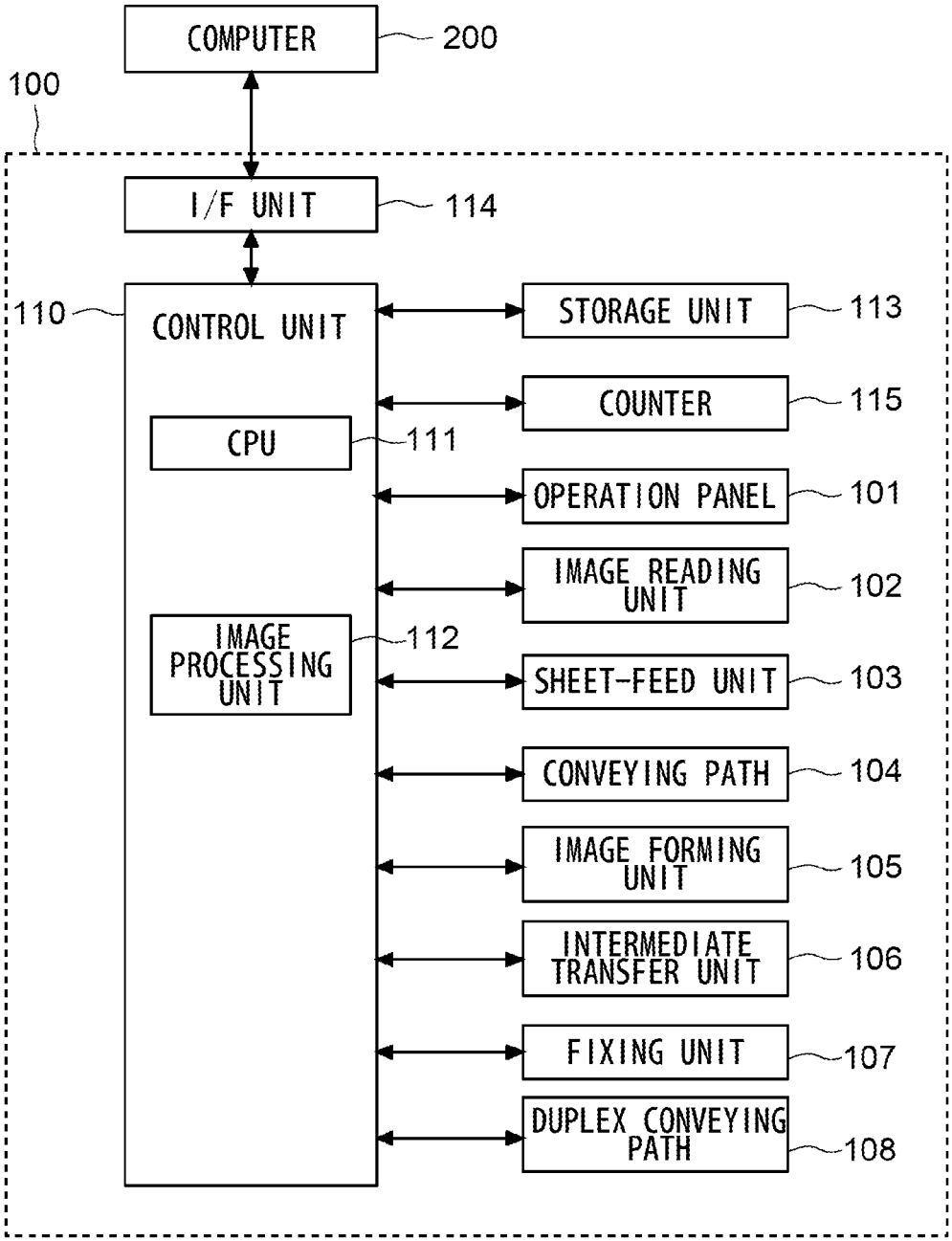
FIG. 3 is a block diagram illustrating a hardware configuration of the image forming apparatus including the sheet feeding device according to the embodiment of the present disclosure.

Next, a hardware configuration of the multifunction peripheral 100 is described with reference to FIG. 3.

The multifunction peripheral 100 has a control unit 110 therein. The control unit 110 includes a central processing unit (CPU) 111 and an image processing unit 112, and controls each component of the multifunction peripheral 100. Note that, the control unit 110 may be divided into a main control section for performing overall control and image processing, and an engine control section for controlling printing by turning ON/OFF a motor for rotating various rotators.

Further, the control unit 110 is connected to a storage unit 113. The storage unit 113 is formed of a combination of a non-volatile storage device and a volatile storage device, and includes, for example, a ROM, a RAM, a flash ROM, and an HDD. For example, the storage unit 113 stores a control program and control data of the multifunction peripheral 100. Then, the CPU 111 carries out computation and controls each component of the multifunction peripheral 100, based on the control program and the control data stored in the storage unit 113.

Further, the control unit 110 is connected to an I/F unit 114. The I/F unit 114 is a communication interface for communicating with a computer 200 (e.g., a personal computer) serving as a transmission source of printing data (data containing image data and setting data for printing) through a network or a cable. Further, the I/F unit 114 may contain a modem or the like so that the I/F unit 114 can transmit/receive image data and the like to/from an external FAX device.

The image processing unit 112 performs various kinds of image processing, such as enlargement, reduction, density conversion, and data format conversion, on the image data from the computer 200 in accordance with the setting.

The control unit 110 is also connected to the operation panel 101, the image reading unit 102, the sheet-feed unit 103, the conveying path 104, the image forming unit 105, the intermediate transfer unit 106, the fixing unit 107, the duplex conveying path 108, a counter 115, and the like, and controls the operation of each component based on the control program and data stored in the storage unit 113.

Next, the configuration of the sheet-feed unit 103 is described in detail with reference to FIGS. 4 and 5.

The sheet P to be contained in the sheet-feed unit 103 is to be placed on a placement surface 31*a* of a bottom plate 31 (corresponding to a placement member). When a plurality of sheets P are placed on the placement surface 31*a* of the bottom plate 31, the plurality of sheets P are stacked on the placement surface 31*a* of the bottom plate 31.

One end side of the bottom plate 31 is supported by a shaft 32. Further, the other end side of the bottom plate 31 is lifted up toward the placement surface 31*a* side from an opposite surface side of the placement surface 31*a* by a lifting member 33 (for example, a compression coil spring). Therefore, the other end side of the bottom plate 31 is lifted up by the lifting member 33 so as to pivot in a direction toward a pickup roller 35 (described later) with the shaft 32 being a pivot point.

A friction pad 34 (corresponding to a friction body) is mounted to a part of the placement surface 31*a* of the bottom plate 31 on the other end side. Although the material for the friction pad 34 is not particularly limited, examples thereof include cork and rubber.

When the friction pad 34 is provided, a lowermost sheet P in a sheet bundle obtained by stacking the plurality of sheets P abuts against the friction pad 34. Therefore, the lowermost sheet P becomes less liable to be displaced, which ensures the shape retention of the sheet bundle.

In a region opposed to the friction pad 34 on the side of the placement surface 31*a* of the bottom plate 31, the pickup roller 35 is disposed. Therefore, under a state in which the sheet P is placed on the bottom plate 31 (state illustrated in FIG. 4), the sheet P is sandwiched between the friction pad 34 and the pickup roller 35. That is, an uppermost sheet P in the sheet bundle is pressed against the pickup roller 35 due to the urging force of the lifting member 33. On the other hand, under a state in which the sheet P is not placed on the bottom plate 31 (state illustrated in FIG. 5), the friction pad 34 is pressed against the pickup roller 35 due to the urging force of the lifting member 33.

Figure 4:
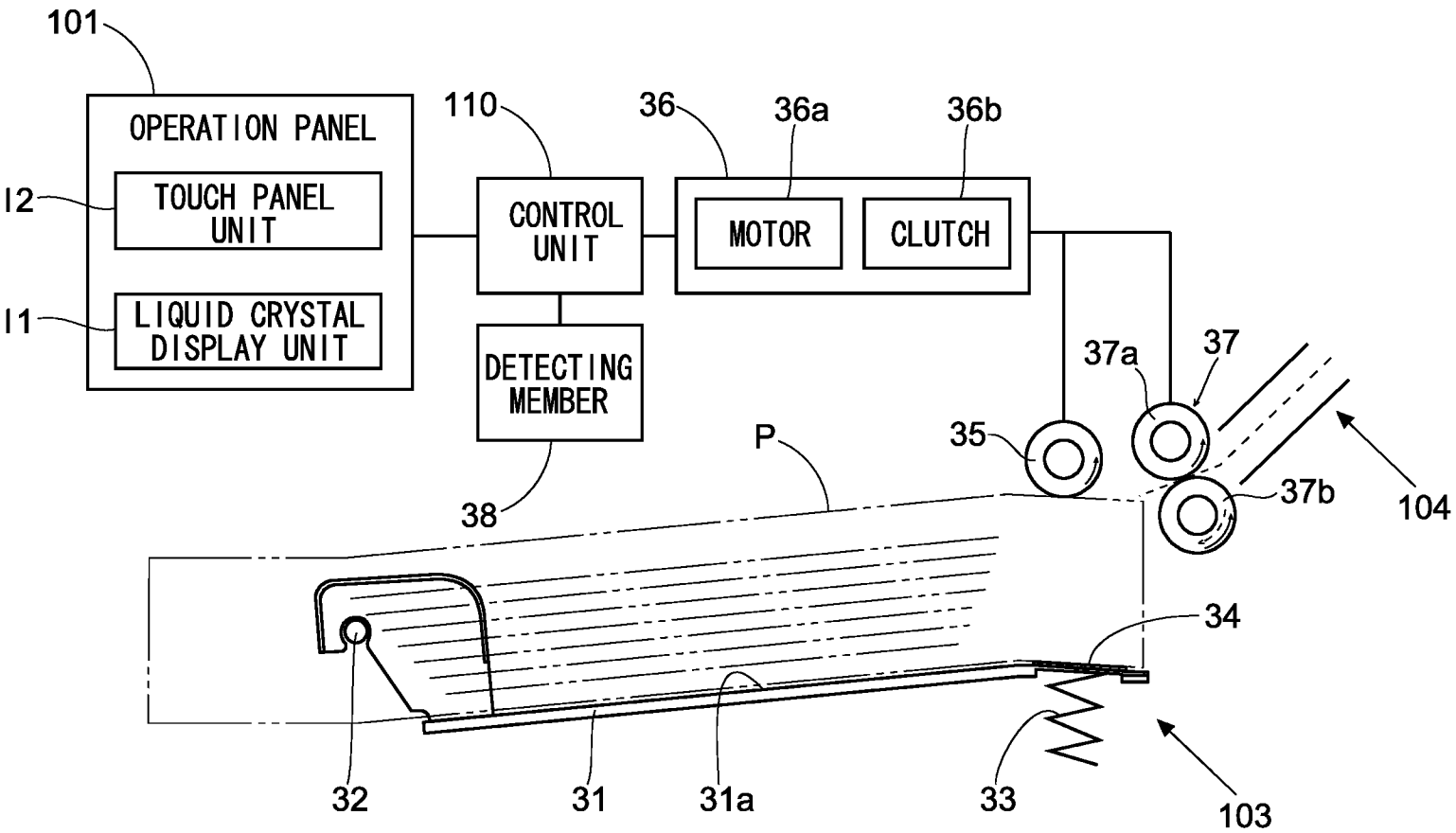
FIG. 4 is a schematic view (view illustrating a state in which a recording medium is contained) of the sheet feeding device according to the embodiment of the present disclosure.
Figure 5:
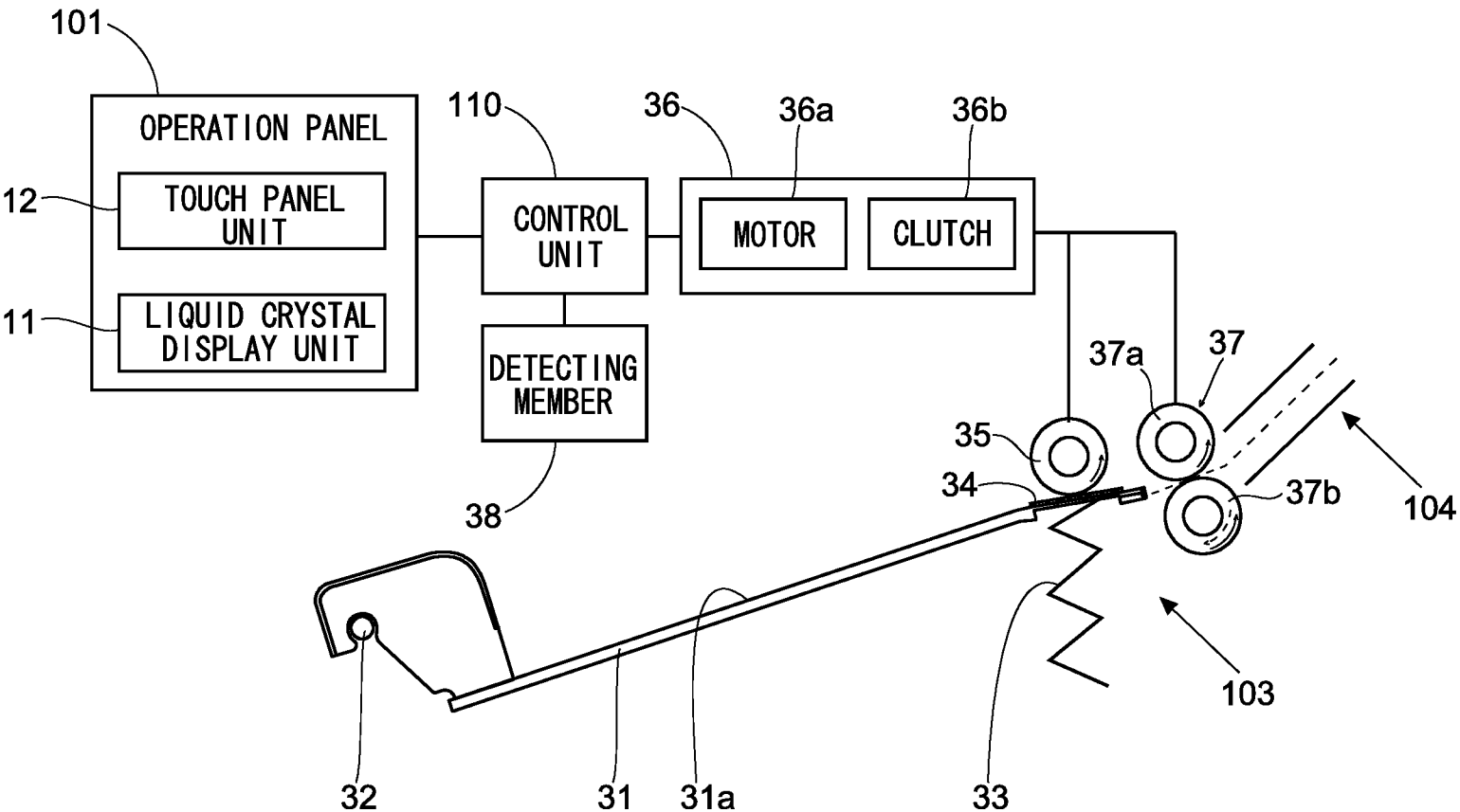
FIG. 5 is a schematic view (view illustrating a state in which the recording medium is not contained) of the sheet feeding device according to the embodiment of the present disclosure.

Further, the pickup roller 35 has a drive force applied from a drive mechanism 36 to rotate in a direction of an arrow in FIGS. 4 and 5. The drive mechanism 36 includes a motor 36*a*, a clutch 36*b*, and a gear (not shown). The drive mechanism 36 drives the motor 36*a* and switches ON/OFF the clutch 36*b* in response to a control signal from the control unit 110.

When the clutch 36*b* is switched ON, the drive force of the motor 36*a* is transmitted to the pickup roller 35, and hence, the pickup roller 35 rotates in the direction of the arrow in FIGS. 4 and 5. At this time, when the sheet P is placed on the bottom plate 31 (when the sheet P abuts against the pickup roller 35), the sheet P is pulled out from the bottom plate 31. On the other hand, when the clutch 36*b* is switched OFF, the transmission of the drive force from the motor 36*a* to the pickup roller 35 is blocked, and hence, the pickup roller 35 does not rotate.

The sheet P pulled out from the bottom plate 31 by the pickup roller 35 reaches separation rollers 37. The sheet P is sent in a sheet-feed direction (direction toward the conveying path 104) by the separation rollers 37 and fed to the conveying path 104 one by one.

The separation rollers 37 include a feed roller 37*a* and a retard roller 37*b* disposed so as to be opposed to each other while sandwiching a path line (line indicated by a broken line in FIGS. 4 and 5) therebetween. The drive force is transmitted to the separation rollers 37 from the drive mechanism 36 in the same way as in the pickup roller 35. Thus, the separation rollers 37 rotate.

The feed roller 37*a* rotates in a direction of an arrow in FIGS. 4 and 5 due to the drive force transmitted from the drive mechanism 36. Note that, the retard roller 37*b* rotates in a direction of a solid arrow in FIGS. 4 and 5 due to the drive force transmitted from the drive mechanism 36. Note that, the retard roller 37*b* contains a torque limiter (not shown). Thus, in a case where a load on an outer circumferential surface of the retard roller 37*b* exceeds a set critical value of the torque limiter, even when the drive force is transmitted from the drive mechanism 36 to the retard roller 37*b*, the retard roller 37*b* does not rotate in the direction of the solid arrow in FIGS. 4 and 5.

Thus, in a case where only one sheet P is sent to a region between the feed roller 37*a* and the retard roller 37*b*, the sheet P abuts against the feed roller 37*a* to be sent in the sheet-feed direction. At this time, a load (in this case, a load exceeding the set critical value of the torque limiter) in the sheet-feed direction, which the sheet P receives from the feed roller 37*a*, is applied directly to the outer circumferential surface of the retard roller 37*b*. Therefore, the retard roller 37*b* does not rotate in the direction of the solid arrow in FIGS. 4 and 5, but rotates in a direction of a broken arrow in FIGS. 4 and 5 in association with the movement of the sheet P sent in the sheet-feed direction. Thus, the sheet P is fed to the conveying path 104.

On the other hand, in a case where two sheets P are sent together to the region between the feed roller 37*a* and the retard roller 37*b*, the uppermost sheet P abuts against the feed roller 37*a* to be sent in the sheet-feed direction. At this time, a load (a load exceeding the set critical value of the torque limiter) in the sheet-feed direction, which the uppermost sheet P receives from the feed roller 37*a*, is not applied to the outer circumferential surface of the retard roller 37*b* due to the presence of the lowermost sheet P. That is, the retard roller 37*b* continues to rotate in the direction of the solid arrow in FIGS. 4 and 5. Therefore, the uppermost sheet P is fed to the conveying path 104 due to the abutment against the feed roller 37*a*, whereas the lowermost sheet P is not fed to the conveying path 104 due to the abutment against the retard roller 37*b*.

When the sheet P is fed to the conveying path 104 by the pickup roller 35 and the separation rollers 37, the clutch 36*b* is switched ON under a state in which the motor 36*a* is driven. That is, the pickup roller 35 and the separation rollers 37 are rotated. Thus, the uppermost sheet P (sheet P abutting against the pickup roller 35) is pulled out from the bottom plate 31 by the pickup roller 35, and the sheet P is sent to the separation rollers 37 (the region between the feed roller 37*a* and the retard roller 37*b*).

Then, the sheet P sent to the separation rollers 37 is fed to the conveying path 104 by the feed roller 37*a*. At this time, even when two or more sheets P are pulled out from the bottom plate 31 by the pickup roller 35, the two or more sheets P are separated by the retard roller 37*b*. Therefore, the two or more sheets P are not fed to the conveying path 104 in a superimposed manner.

When the sheet P passes through the separation rollers 37 and is fed to the conveying path 104, the clutch 36*b* is switched off Thus, the drive force of the motor 36*a* is not transmitted to the pickup roller 35 and the separation rollers 37, and the rotation of the pickup roller 35 and the separation rollers 37 stops. After that, in a case where a second sheet P is printed successively, the clutch 36*b* is switched ON at a timing when a space between the first sheet P and the second sheet P falls within a desired space. Thus, the pickup roller 35 and the separation rollers 37 start rotating again, and subsequently, the second sheet P is fed to the conveying path 104.

Further, the sheet-feed unit 103 is also provided with a detecting member 38 for detecting whether or not the sheet P is placed on the bottom plate 31. The detecting member 38 is, for example, an optical sensor, and an output voltage thereof is input to the control unit 110. Thus, the control unit 110 determines whether or not the sheet P is placed on the bottom plate 31 based on a difference in the output voltage of the detecting member 38.

By the way, an outer circumferential surface of the pickup roller 35 has an uneven surface in which grooves are formed. Therefore, even when a certain amount of paper powder flies from the sheet P, the paper powder is retained in the grooves in the outer circumferential surface of the pickup roller 35, and hence, the paper powder does not easily adhere to the outermost surface of the outer circumferential surface of the pickup roller 35. Consequently, a sheet-feed failure (problem that the pickup roller 35 idly rotates in spite of the fact that the pickup roller 35 and the sheet P abut against each other) is prevented.

However, when the multifunction peripheral 100 is used for a long period of time, the outer circumferential surface of the pickup roller 35 is worn out, which reduces the depth of the grooves in the outer circumferential surface of the pickup roller 35. Therefore, the paper powder flown from the sheet P cannot be retained in the grooves in the outer circumferential surface of the pickup roller 35. Then, the paper powder that cannot be retained in the grooves in the outer circumferential surface of the pickup roller 35 adheres to the outermost surface of the outer circumferential surface of the pickup roller 35 to cause a sheet-feed failure. Further, even in a case where the wear of the outer circumferential surface of the pickup roller 35 is not so serious, when the number of printed sheets is about several tens of thousands (for example, 50,000), there is a high risk that the paper powder may adhere to the outermost surface of the outer circumferential surface of the pickup roller 35 to cause a sheet-feed failure. Further, there are countries or regions where a sheet P from which a large amount of paper powder flies is used daily, and hence, a sheet-feed failure may occur frequently.

Therefore, in this embodiment, the sheet powder adhering to the outermost surface of the outer circumferential surface of the pickup roller 35 is removed by cleaning the pickup roller 35.

Hereinafter, an operation of cleaning the pickup roller 35 is described with reference to FIG. 6. Note that, in the following description, a case where the pickup roller 35 is cleaned when the number of printed sheets is 50,000 or more (when 50,000 or more sheets are printed after a sheet is fed for the first time by the pickup roller 35, or when 50,000 or more sheets are printed after the previous cleaning of the pickup roller 35) is taken as an example. However, the time when the pickup roller 35 is cleaned is not particularly limited. For example, in the case of using a sheet P with bad quality (sheet from which paper powder flies easily), the pickup roller 35 may be cleaned at a time when the number of printed sheets is less than 50,000.

First, in Step S1, the control unit 110 determines the number of printed sheets counted by the counter 115. Further, in Step S2, the control unit 110 determines whether or not the number of printed sheets is 50,000 or more. When the number of printed sheets is not 50,000 or more, the process returns to Step S1. On the other hand, when the number of printed sheets is 50,000 or more, the process proceeds to Step S3.

In Step S3, the control unit 110 determines whether or not the sheet P is placed on the bottom plate 31 based on the output voltage of the detecting member 38. At this time, when the sheet P is placed on the bottom plate 31, the control unit 110 repeats the operation of Step S3 until the sheet P placed on the bottom plate 31 is used up. Then, in a case where the feeding of a last sheet P remaining on the bottom plate 31 to the conveying path 104 is completed (in the case where the sheet P is not placed on the bottom plate 31), the process proceeds to Step S4. When the sheet P is not placed on the bottom plate 31, the friction pad 34 is pressed against the pickup roller 35 due to the urging force of the lifting member 33.

When the process proceeds to Step S4, the drive mechanism 36 switches the clutch 36*b* from an OFF state to an ON state, and transmits the drive force of the motor 36*a* to the pickup roller 35 so as to rotate the pickup roller 35. That is, the drive mechanism 36 causes the pickup roller 35 to idly rotate under a state in which the friction pad 34 abuts against the pickup roller 35.

When the pickup roller 35 is caused to idly rotate in this manner, the pickup roller 35 and the friction pad 34 rub against each other. Therefore, the paper powder adhering to the outermost surface of the outer circumferential surface of the pickup roller 35 is removed, and hence the pickup roller 35 is cleaned.

The inventors of this application actually performed the cleaning of the pickup roller 35 in which the pickup roller 35 having paper powder adhering to the outermost surface of the outer circumferential surface thereof was allowed to idly rotate under a state in which the pickup roller 35 abutted against the friction pad 34. As a result, the inventors found that, when an idle rotation time of the pickup roller 35 was about 10 seconds, the cleaning of the pickup roller 35 was performed satisfactorily. Thus, it can be said that about 10 seconds suffice as the idle rotation time of the pickup roller 35.

Next, the process proceeds to Step S5 while the pickup roller 35 is allowed to idly rotate, and the control unit 110 displays information indicating that the pickup roller 35 is being cleaned on the liquid crystal display unit 11 (or the computer 200).

Then, in Step S6, the control unit 110 determines whether or not an operation of reloading the sheet P to the bottom plate 31 is performed. At this time, in the case where the operation of reloading the sheet P to the bottom plate 31 is performed, the process proceeds to Step S7, and the drive mechanism 36 stops the cleaning (idle rotation) of the pickup roller 35 temporarily. Further, in Step S8, when the sheet P is placed on the bottom plate 31, the control unit 110 displays information for prompting a user to remove the sheet P from the bottom plate 31 on the liquid crystal display unit 11 (or the computer 200) until the sheet P is removed from the bottom plate 31. Herein, whether or not the sheet P is placed on the bottom plate 31 is determined based on the output voltage of the detecting member 38. Then, in Step S9, after the sheet P is removed from the bottom plate 31, the drive mechanism 36 resumes the cleaning (idle rotation) of the pickup roller 35. In Step S6, when no operation of reloading the sheet P is performed in a period in which the idle rotation time of the pickup roller 35 reaches a predetermined period of time (about 10 seconds), the process proceeds to Step S10.

Finally, in Step S10, the drive mechanism 36 completes the cleaning (idle rotation) of the pickup roller 35.

Note that, the pickup roller 35 may be cleaned in accordance with a flow different from the above-mentioned flow. Hereinafter, modified examples of the operation of cleaning the pickup roller 35 are described.

Figure 7:
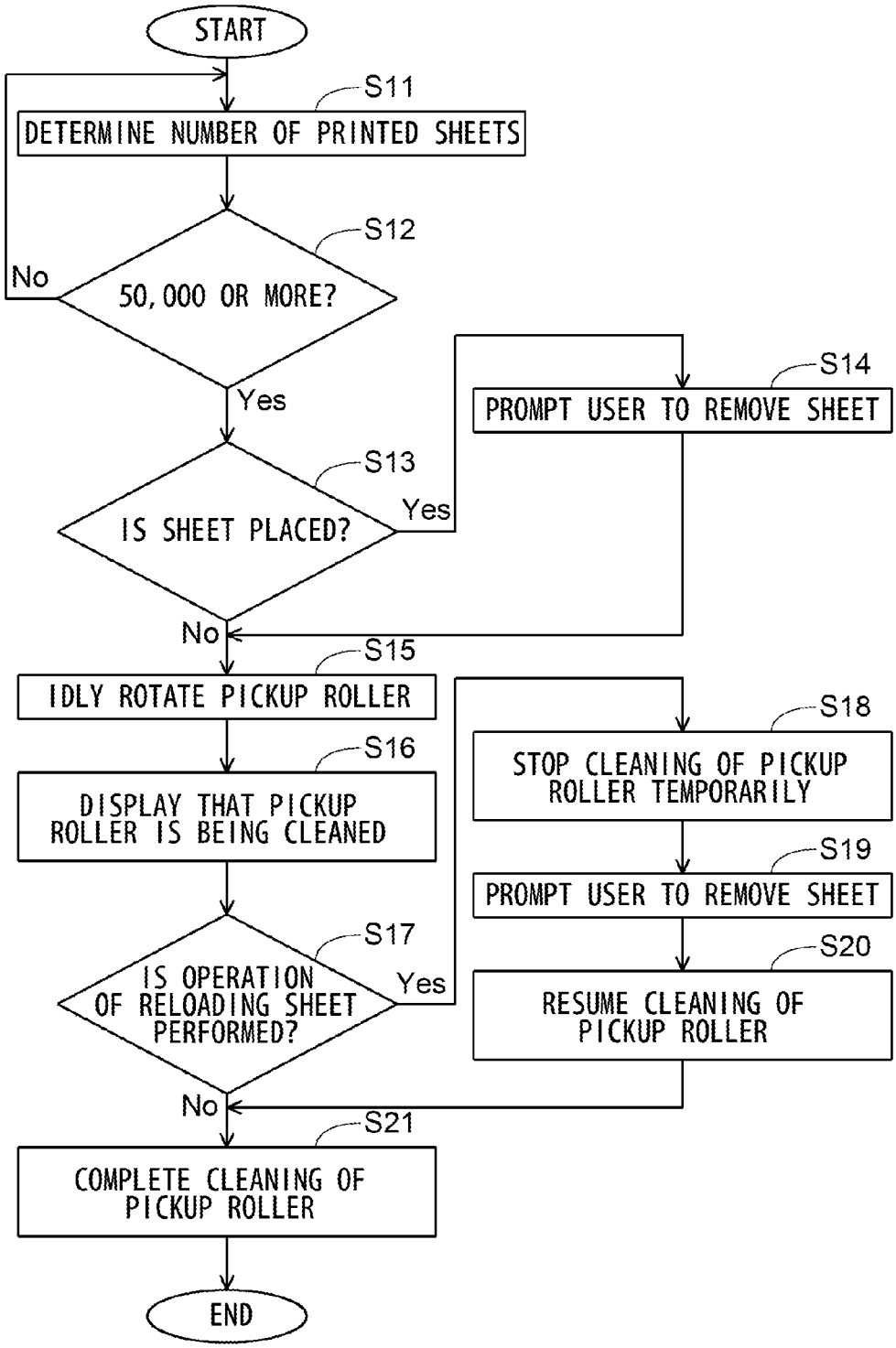
FIG. 7 is a flowchart illustrating an operation (cleaning operation for the pickup roller) of a sheet feeding device according to a first modified example of the present disclosure.

According to a first modified example of the present disclosure, as illustrated in FIG. 7, first, in Step S11, the control unit 110 determines the number of printed sheets counted by the counter 115. Further, in Step S12, the control unit 110 determines whether or not the number of printed sheets is 50,000 or more. When the number of printed sheets is not 50,000 or more, the process returns to Step S11. On the other hand, when the number of printed sheets is 50,000 or more, the process proceeds to Step S13.

In Step S13, the control unit 110 determines whether or not the sheet P is placed on the bottom plate 31 based on the output voltage of the detecting member 38. At this time, when the sheet P is placed on the bottom plate 31, the process proceeds to Step S14, and the control unit 110 displays information for prompting the user to remove the sheet P from the bottom plate 31 on the liquid crystal display unit 11 (or the computer 200). Then, in the case where the sheet P is not placed on the bottom plate 31 from the beginning, or in the case where the sheet P has been removed from the bottom plate 31, the process proceeds to Step S15.

Figure 6:
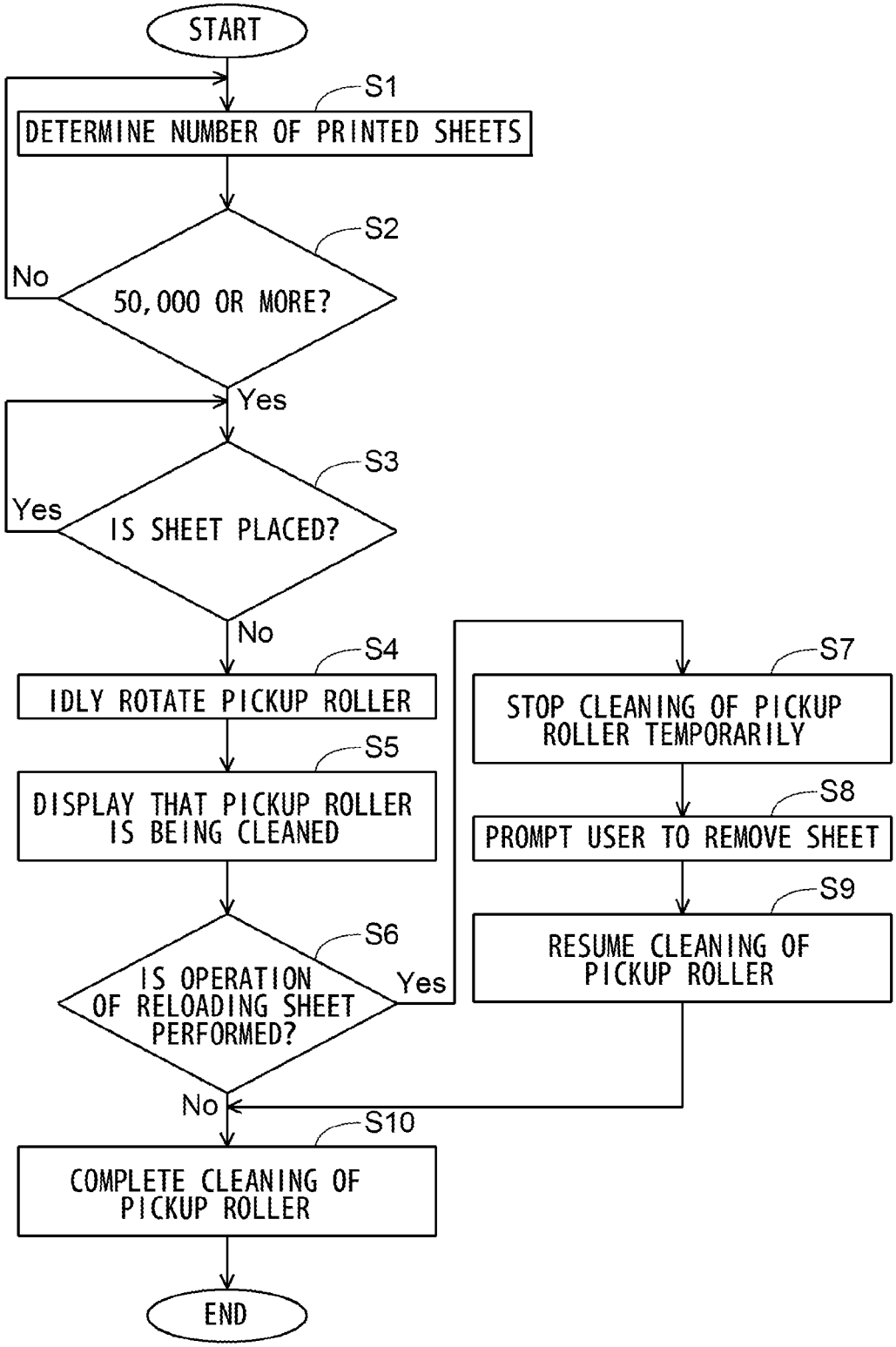
FIG. 6 is a flowchart illustrating an operation (cleaning operation for a pickup roller) of the sheet feeding device according to the embodiment of the present disclosure.

Note that, the operations of Steps S15 to S21 are the same as those of Steps S4 to S10 illustrated in FIG. 6. Thus, the descriptions of the operations of Steps S15 to S21 are omitted by employing the descriptions of the operations of Steps S4 to S10 illustrated in FIG. 6.

Further, as a second modified example of the present disclosure, the pickup roller 35 may be cleaned based on an operation of the touch panel unit 12 by the user.

Figure 8:
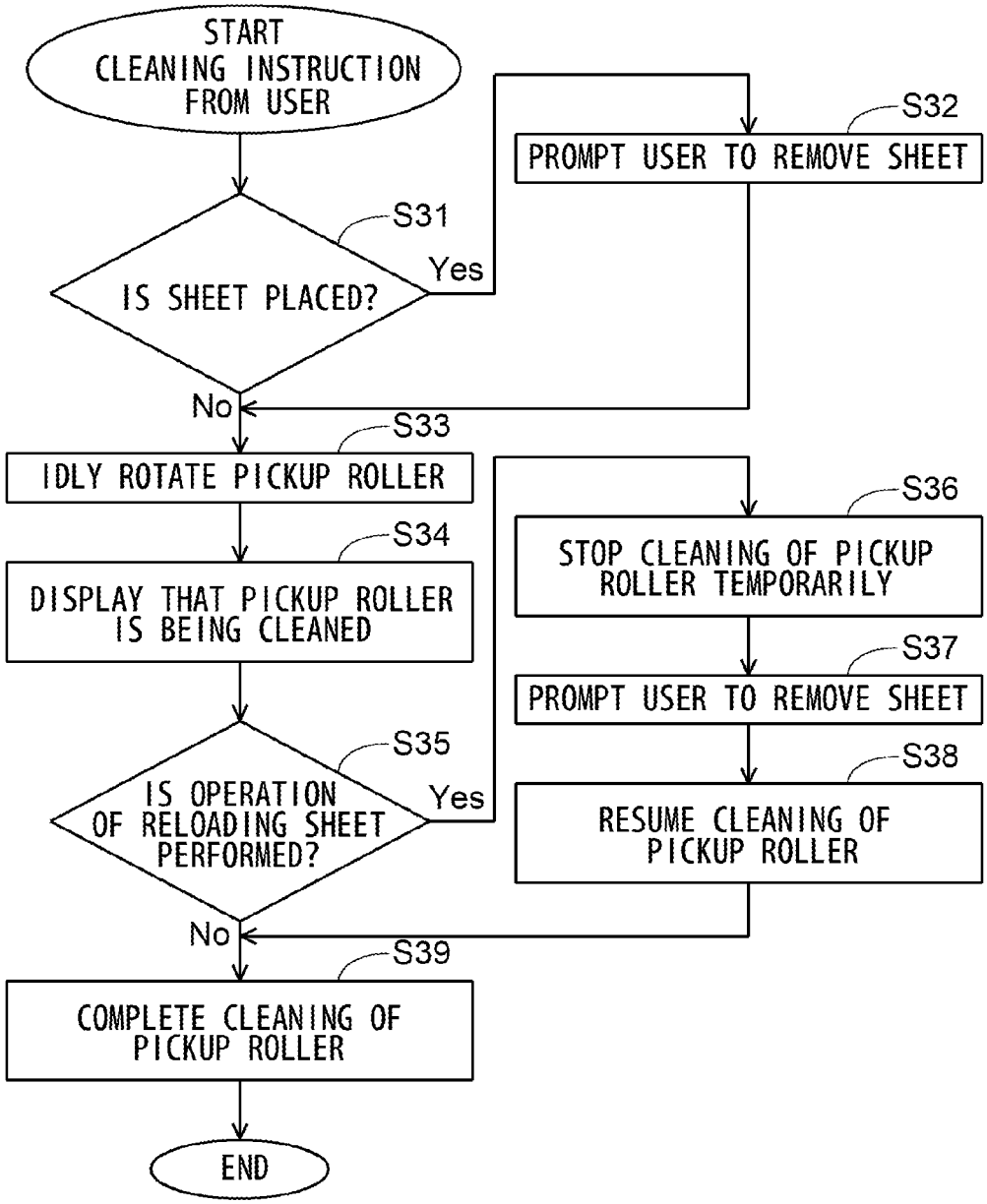
FIG. 8 is a flowchart illustrating an operation (cleaning operation for the pickup roller) of a sheet feeding device according to a second modified example of the present disclosure.

According to the second modified example, as illustrated in FIG. 8, first, the user operates the touch panel unit 12 so that the pickup roller 35 is cleaned. When the start of cleaning of the pickup roller 35 is instructed, the process proceeds to Step S31.

In Step S31, the control unit 110 determines whether or not the sheet P is placed on the bottom plate 31 based on the output voltage of the detecting member 38. At this time, when the sheet P is placed on the bottom plate 31, the process proceeds to Step S32, and the control unit 110 displays information for prompting the user to remove the sheet P from the bottom plate 31 on the liquid crystal display unit 11 (or the computer 200). Then, in the case where the sheet P is not placed on the bottom plate 31 from the beginning, or in the case where the sheet P has been removed from the bottom plate 31, the process proceeds to Step S33.

Note that, the operations of Steps S33 to S39 are the same as those of Steps S4 to S10 illustrated in FIG. 6. Thus, the descriptions of the operations of Steps S33 to S39 are omitted by employing the descriptions of the operations of Steps S4 to S10 illustrated in FIG. 6.

As described above, the multifunction peripheral 100 (image forming apparatus) of this embodiment (including the first and second modified examples) includes the bottom plate 31 (placement member) having the placement surface 31*a* on which the sheet P (recording medium) is placed, the friction pad 34 (friction body) mounted to a part of the placement surface 31*a* of the bottom plate 31, the pickup roller 35 disposed so as to be opposed to the friction pad 34 on the side of the placement surface 31*a* of the bottom plate 31, for pulling out the sheet P from the bottom plate 31 by rotating in abutment against the sheet P, the drive mechanism 36 for rotationally driving the pickup roller 35, and the lifting member 33 for lifting up the bottom plate 31 so as to bring the sheet P into abutment against the pickup roller 35 when the sheet P is placed on the bottom plate 31 and bring the friction pad 34 into abutment against the pickup roller 35 when the sheet P is not placed on the bottom plate 31. The drive mechanism 36 rotates the pickup roller 35 under a state in which the pickup roller 35 abuts against the friction pad 34, to thereby clean the pickup roller 35.

In the configuration of this embodiment, even when paper powder adheres to the outermost surface of the outer circumferential surface of the pickup roller 35, the drive mechanism 36 rotates the pickup roller 35 under a state in which the pickup roller 35 abuts against the friction pad 34. This allows the pickup roller 35 and the friction pad 34 to rub against each other, and hence, the paper powder adhering to the outermost surface of the outer circumferential surface of the pickup roller 35 is removed, and the original friction force of the pickup roller 35 can be restored. Therefore, the problem that the sheet P is not pulled out from the bottom plate 35 satisfactorily (the pickup roller 35 idly rotates in spite of the fact that the pickup roller 35 and the sheet P abut against each other) is avoided.

Further, in the configuration of this embodiment, it is not necessary to separately provide the cleaning member (including a drive mechanism for driving the cleaning member) for cleaning the pickup roller 35, which can prevent an increase in number of components. Further, it is not necessary to secure a space for disposing the cleaning member, and hence, the device can be downsized.

Consequently, in the configuration of this embodiment, the pickup roller 35 can be cleaned satisfactorily while an increase in number of components is prevented and the device is downsized.

The multifunction peripheral 100 of this embodiment further includes the detecting member 38 for detecting whether or not the sheet P is placed on the bottom plate 31. When it is determined, through the detection using the detecting member 38, that the sheet P is not placed on the bottom plate 31, the drive mechanism 36 performs cleaning of the pickup roller 35. In such a configuration, when the drive mechanism 36 performs cleaning of the pickup roller 35, the pickup roller 35 abuts against the friction pad 34 reliably. Further, every time the sheet P contained in the sheet-feed unit 103 is used up, the pickup roller 35 is cleaned automatically. Therefore, the pickup roller 35 is cleaned periodically, and the friction force of the pickup roller 35 can be kept at a predetermined value or higher at all times.

Further, in the multifunction peripheral 100 of this embodiment, when the drive mechanism 36 is performing cleaning of the pickup roller 35, the liquid crystal display device 11 (display unit) displays information indicating that the pickup roller 35 is being cleaned. In this configuration, such a problem is prevented in which the cleaning of the pickup roller 35 is stopped when the user places the sheet P on the bottom plate 31 during the cleaning of the pickup roller 35.

Further, in the multifunction peripheral 100 of this embodiment, when the sheet P is placed on the bottom plate 31 during the cleaning of the pickup roller 35, the liquid crystal display unit 11 displays information for prompting the user to remove the sheet P from the bottom plate 31. In this configuration, even when the user places the sheet P on the bottom plate 31 during the cleaning of the pickup roller 35, the user can be prompted to remove the sheet P from the bottom plate 31.

In this case, until the sheet P is removed from the bottom plate 31, the drive mechanism 36 stops the cleaning of the pickup roller 35 temporarily. In this configuration, such a problem is prevented in which the pickup roller 35 pulls out the sheet P from the bottom plate 31 in spite of the fact that the pickup roller 35 is being cleaned.

Note that, in the configuration of this embodiment, the user may operate the touch panel unit 12 (operation unit) to drive the drive mechanism 36 so that the drive mechanism 36 performs cleaning of the pickup roller 35 (that is, as in the second modified example). In this case, when the user determines that the problem that the sheet P is not satisfactorily pulled out from the bottom plate 31 frequently occurs, the pickup roller 35 can be cleaned.

It should be understood that the embodiment disclosed herein is shown for an illustrative purpose in all respects and is not limitative. The scope of the present disclosure is not shown by the above description of the embodiment but by the claims, and further, incorporates all modifications in the spirit and scope equivalent to those of the claims.

In the above-mentioned embodiment, for example, the case where the present disclosure is applied to a multifunction peripheral is described. However, the present disclosure is not limited thereto and is also applicable to an image forming apparatus other than a multifunction peripheral. That is, the present disclosure is applicable to various image forming apparatus such as a copier, a fax machine, a printer, and a multifunction peripheral thereof

What is claimed is:

1. A sheet feeding device, comprising:

a placement member having a placement surface on which a recording medium is placed;

a friction body mounted to a part of the placement surface of the placement member;

a pickup roller disposed so as to be opposed to the friction body on a side of the placement surface of the placement member, for pulling out the recording medium from the placement member by rotating in abutment against the recording medium;

a drive mechanism for rotationally driving the pickup roller;

a lifting member for lifting up the placement member so as to bring the recording medium into abutment against the pickup roller when the recording medium is placed on the placement member and bring the friction body into abutment against the pickup roller when the recording medium is not placed on the placement member;

a detecting member for detecting whether or not the recording medium is placed on the placement member; and a display unit for displaying a state of the sheet feeding device, wherein an outer circumferential surface of the pickup roller has an uneven surface in which grooves are formed, wherein, when it is determined, through detection using the detecting member, that the recording medium is not placed on the placement member, the drive mechanism rotates the pickup roller under a state in which the pickup roller abuts against the friction body, to thereby clean the pickup roller, wherein, when it is determined by the detecting member that the recording medium is placed on the placement member during cleaning of the pickup roller, the drive mechanism stops rotation of the pickup roller to stop the cleaning of the pickup roller temporarily, and the display unit displays information for prompting a user to remove the recording medium from the placement member, and wherein, when it is determined by the detecting member that the recording medium is removed from the placement member after the cleaning of the pickup roller has been stopped temporarily, the drive mechanism restarts the cleaning of the pickup roller.

2. The sheet feeding device according to claim 1, further comprising:

a placement member having a placement surface on which a recording medium is placed;

a friction body mounted to a part of the placement surface of the placement member;

a pickup roller disposed so as to be opposed to the friction body on a side of the placement surface of the placement member, for pulling out the recording medium from the placement member by rotating in abutment against the recording medium;

a drive mechanism for rotationally driving the pickup roller;

a lifting member for lifting up the placement member so as to bring the recording medium into abutment against the pickup roller when the recording medium is placed on the placement member and bring the friction body into abutment against the pickup roller when the recording medium is not placed on the placement member, and an operation unit to be operated by a user, wherein the drive mechanism rotates the pickup roller under a state in which the pickup roller abuts against the friction body, to thereby clean the pickup roller, wherein the user operates the operation unit to drive the drive mechanism so that the drive mechanism performs cleaning of the pickup roller.

3. The sheet feeding device according to claim 1 or 2, further comprising a display unit for displaying a state of the sheet feeding device, wherein, when the drive mechanism is performing cleaning of the pickup roller, the display unit displays information indicating that the pickup roller is being cleaned.

4. An image forming apparatus, comprising the sheet feeding device according to claim 1 or 2.

5. A method of controlling a sheet feeding device, the sheet feeding device including:

a placement member having a placement surface on which a recording medium is placed;

a friction body mounted to a part of the placement surface of the placement member;

a pickup roller disposed so as to be opposed to the friction body on a side of the placement surface of the placement member, for pulling out the recording medium from the placement member by rotating in abutment against the recording medium;

a lifting member for lifting up the placement member so as to bring the recording medium into abutment against the pickup roller when the recording medium is placed on the placement member and bring the friction body into abutment against the pickup roller when the recording medium is not placed on the placement member; and a detecting member for detecting whether or not the recording medium is placed on the placement member, wherein an outer circumferential surface of the pickup roller has an uneven surface in which grooves are formed, the method comprising:

bringing the friction body into abutment against the pickup roller;

detecting, using the detecting member, whether or not the recording medium is placed on the placement member;

when it is determined, through detection using the detecting member, that the recording medium is not placed on the placement member, rotating the pickup roller under a state in which the pickup roller abuts against the friction body, to thereby clean the pickup roller;

when it is determined by the detecting member that the recording medium is placed on the placement member during cleaning of the pickup roller, stopping rotation of the pickup roller to stop the cleaning of the pickup roller temporarily, and displaying, on a display unit, information for prompting a user to remove the recording medium from the placement member; and when it is determined by the detecting member that the recording medium is removed from the placement member after the cleaning of the pickup roller has been stopped temporarily, restarting the cleaning of the pickup roller.

6. The method of controlling a sheet feeding device according to claim 5, the sheet feeding device including:

a placement member having a placement surface on which a recording medium is placed;

a friction body mounted to a part of the placement surface of the placement member;

a pickup roller disposed so as to be opposed to the friction body on a side of the placement surface of the placement member, for pulling out the recording medium from the placement member by rotating in abutment against the recording medium; and a lifting member for lifting up the placement member so as to bring the recording medium into abutment against the pickup roller when the recording medium is placed on the placement member and bring the friction body into abutment against the pickup roller when the recording medium is not placed on the placement member, the method comprising:

bringing the friction body into abutment against the pickup roller;

rotating the pickup roller under a state in which the pickup roller abuts against the friction body, to thereby clean the pickup roller, and cleaning the pickup roller when a user instructs a start of cleaning of the pickup roller.

7. The method of controlling a sheet feeding device according to claim 5 or 6, further comprising displaying, on a display unit, during cleaning of the pickup roller, information indicating that the pickup roller is being cleaned.

* * * * *